US005105448A

United States Patent [19]

Kashiwabara

[11] Patent Number: 5,105,448

[45] Date of Patent: Apr. 14, 1992

[54] DEVICE FOR COUNTING SMALL PROJECTIONS OR DEPRESSIONS ON SURFACES OF OBJECTS

[75] Inventor: Tarou Kashiwabara, Gotenba, Japan

[73] Assignee: Tokai Carbon Co., Ltd., Tokyo, Japan

[21] Appl. No.: 522,018

[22] Filed: May 11, 1990

[30] Foreign Application Priority Data

Jun. 23, 1989 [JP] Japan ..... 1-162418
Jan. 11, 1990 [JP] Japan ..... 2-924[U]

[51] Int. Cl.[5] ..... G06M 9/00

[52] U.S. Cl. ..... 377/15; 377/8; 377/28

[58] Field of Search ..... 377/8, 15, 23, 55, 112, 377/28; 307/273

[56] References Cited

U.S. PATENT DOCUMENTS 3,497,725 2/1970 Lorditch ..... 307/273
3,571,574 3/1971 Gerber ..... 377/8
3,862,402 1/1975 Igarashi et al. ..... 377/8
4,974,237 11/1990 Grabowski ..... 377/8

FOREIGN PATENT DOCUMENTS 2542831 4/1977 Fed. Rep. of Germany ..... 377/15

*Primary Examiner*—John S. Heyman
*Attorney, Agent, or Firm*—Armstrong, Nikaido, Marmelstein, Kubovcik & Murray

[57] ABSTRACT

A device for counting the number of very small projections on a surface of an object, which includes a casing therein housing a probe to be scanned in contact with the surface of the object having continuously occurring very small projections, a tip end portion of the probe being projected out of a forward end of the casing; a detecting unit including an acceleration sensor; a comparator for converting electric signals emitted from the detecting unit into pulse signals; a latching device provided with a delay circuit for latching the pulse signals received and maintaining its emitted signals for a certain length of time; and a display device for counting and displaying the output signals from the latching device.

6 Claims, 5 Drawing Sheets

DEVICE FOR COUNTING SMALL PROJECTIONS OR DEPRESSIONS ON SURFACES OF OBJECTS

BACKGROUND OF THE INVENTION

1. Field of the Invention

The present invention relates to a device for accurately counting the number of very small projections or depressions continuously occuring on surfaces of objects, using a simple scanning means.

For example, in counting the number of sheets of a stack of paper, generally it is operated to mutually slide the paper sheets to bring their respective one edges to be staggered substantially parallel to one another and count the sheet number by turning the staggered edge portions of the paper sheets with a finger or fingers. The "very small projections or depressions on object surfaces" termed herein for purposes of the description of the present invention means continuously occurring projections of a very small height or extremely shallow depressions or grooves on a surface of an object or in embossed patterns and also such steps as being formed by successively staggering respective one edges of paper sheets in a parallel arrangement as above.

2. Prior Art

As means for determining very small variations in configuration on the surface of an object, it is known to keep a probe contacted on a surface of an intended object for determination while the object is moved and, by converting vertical motions which the probe undergoes along the surface of the object including up and down superficial changes into electric signals, carry out the intended determination.

For example, Japanese patent application Kokai publication No. 60-237310 discloses a device which includes a testing table adapted to be driven in lengthwise and breadthwise directions on a horizontal plane with a candidate object for the determination mounted thereon. In this device, a needle-type probe member for scanning in contact with a surface of the candidate object is vertically movably mounted on a carriage by a spring for adjusting the contact pressure to be applied, and an arrangement is made such that motions of the probe member are converted into electric signals to detect concave or convex changes on the surface of the object. For the means for converting the motion of the probe into electric signals, the publication under reference discloses a one in which the iron core of a differential transformer is attached to the probe to convert the motion of the probe to an electric signal and a one in which the motion of the probe is converted to an electric signal by an optical means, utilizing a laser beam.

Thus, using the above device, it is possible to count the number of for example sheets of a paper by counting the number of vertical motions of the probe after they are comverted into electrical signals, utilizing an electronic circuit.

However, conventional means for detecting projections and/or depressions on an object surface are generally very large in size and relatively complex in structure in that, as is the case with the above cited prior art device, they include a testing table for mounting a candidate object thereon, and involve the need of vertically movably supporting a probe on a carriage and also the need for a differential transformer and an optical device for detecting the vertical motion of the probe.

SUMMARY OF THE INVENTION

It is an object of the present invention to provide a counting device by which the number of for example very small or fine steps formed for example by relatively successively sliding respective one edges of a pile of a thin paper in an arrangement resembling stairs in staircases can be accurately and easily counted by scanning a probe in a manner of rubbing the stepped edges of the paper sheets from a top step to a second top step and so on, in which the probe can be integrally structured with a counter and which can be made a handy device capable of being easily handled by a single hand.

It is another object of the invention to provide a counting device which can count the number of even such projections or depressions on an object surface or steps of stepwise piled objects which have a difference in height of only the order of 10 $\mu$m relative to a reference level or adjacent steps.

The device for counting very small projections or depressions on object surfaces to attain the above objects according to the present invention comprises: a detecting unit having a probe to be scanned in contact with a surface of an object having projections or depressions and an acceleration sensor connected to the probe; a comparator for converting the signals emitted from the detecting unit into pulse signals; a latching means to which the pulse signals from the comparator are fed, the latching means including a latching circuit and a delay circuit for resetting the latching circuit after it has maintained signals received from the latching circuit for a certain length of time; a counter for counting signals issued from the latching means; and an indicator for displaying the result of the counting by the counter.

DESCRIPTION OF THE PREFERRED EMBODIMENTS

Figure 1:
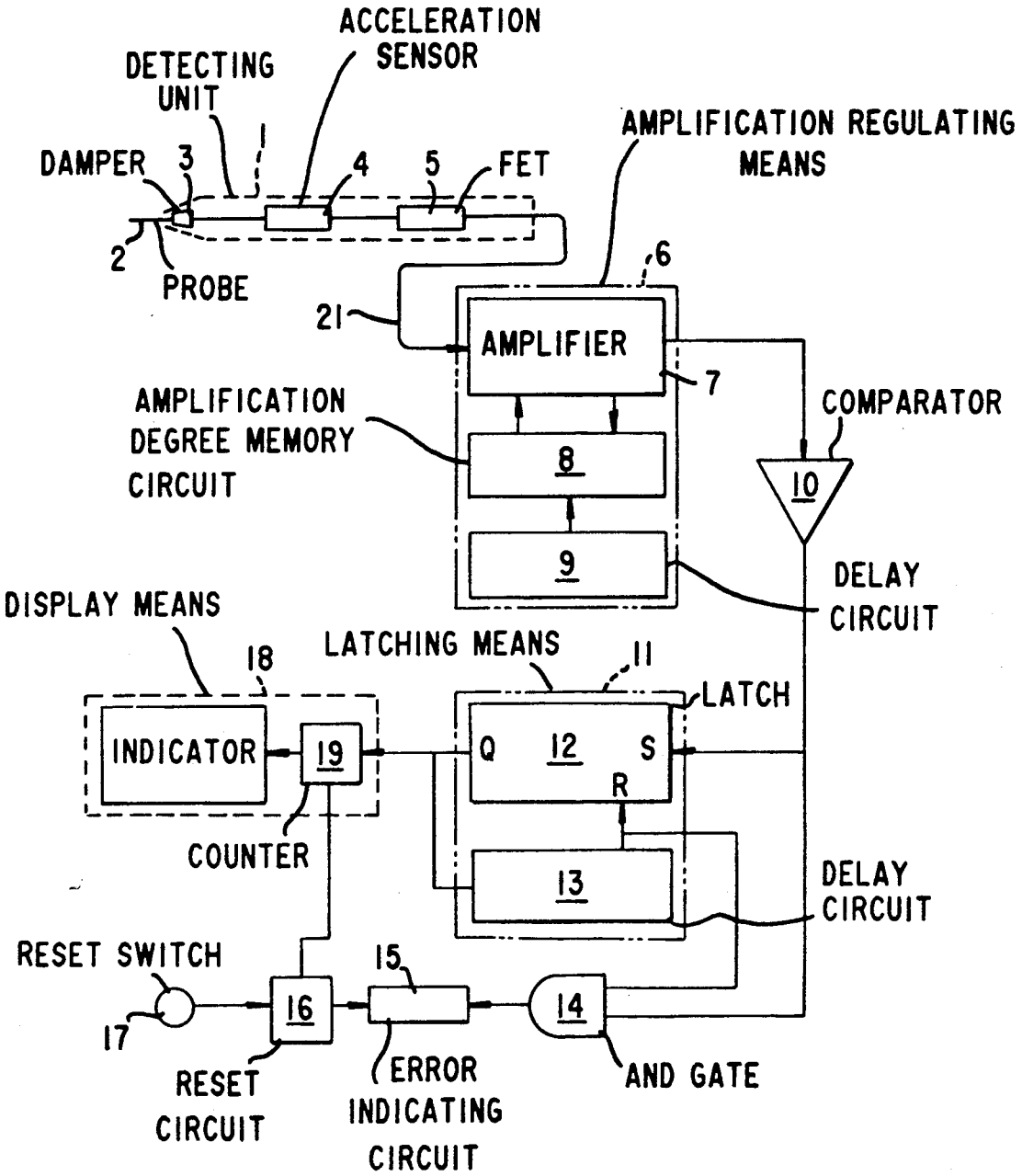
FIG. 1 is a block diagram, showing the circuit of or in a counting device according to a first embodiment of the present invention.

FIG. 1 is a block diagram, showing the circuit in or of a counting device according to a first embodiment of the present invention, in which the numeral 1 denotes a handy detecting unit having housed therein a probe 2 projecting from a front end of the detecting unit 1, a damper 3, an acceleration sensor 4 and an FET (a field effect transistor) 5, 6 denoting an amplification regulating means including an AGC (automatic gain control) amplifier 7, an amplification degree memory circuit 8 and a delay circuit 9, 10 being a comparator or signal converting means, 11 being a latching means including a latch 12 and a delay circuit 13, 14 being an AND gate, 15 being an error indicating circuit, 16 being a reset circuit, 17 being a reset switch, and 18 being a display means including a counter 19 and an indicator 20. Further, the remaining numeral 21 in FIG. 1 shows a signal cable connecting together the detecting unit 1 and a main body of the counting device comprising above cited other members and parts.

In use of the counting device, the detecting unit 1 may be gripped by a hand, and the probe 2 is slided over very fine projections or depressions on an intended surface or a candidate surface of an object for determination in a manner of gently rubbing on the object surface. Mechanical vibratory motions which the probe 2 will undergo as it abuts against projections are transmitted to the damper 3 and, after residual damped oscillations are absorbed by the damper 3, they are converted into electric signals by the acceleration sensor 4. The electric signals are fed to the AGC amplifier 7 of the amplification regulating means 6 in a condition in which the output impedance of the electric signals is lowered by the FET 5 to avoid noise generation. The AGC amplifier 7 controls so that an electric signal of a maximum value out of the electric signals generated when the probe 1 abuts against a first projection or step can produce a constant voltage, and the degree of amplification then measured is kept in memory for a certain length of time by the amplification degree memory circuit 8 and the delay circuit 9. Now that a proper degree of amplification is stored in memory as above, in carrying out the measurement of a second and higher order projections or steps on the object surface, an error in operation likely due to an excess or a shortage of the amplification degree can be effectively avoided.

Output signals of a constant level are sent to the comparator 10 set to be operative at an appreciably lower level than the constant level, and then, in the form of pulses above the set level, sent to the latch 12 comprising a flipflop circuit of the latching means 11 and the AND gate 14. Pulses put into a set terminal S of the latch 12 and put out of an output terminal Q of the latch 12 are, after the lapse of the certain length of time, sent out of the delay circuit 13 into a reset terminal R of the latch 12 and the AND gate 14. Thus, no reset signal is issued during the time when the delay circuit 13 is in operation, so that even if pulses giving rise to a noise generation are sent to the set or input terminal S of the latch 12 before a next normal pulse is put into the latch 12, such pulses are not put out. As a result of this, an interference by a noise tending to be generated due to resonance of the probe in a measurement operation can be avoided.

Pulses put out from the output terminal Q of the latch 12 enter the display means 18 and are counted by the counter 19 and displayed on the indicator 20 in terms of a numerical figure or figures.

The latch 12 is reset by a signal from the delay circuit 13 so that when a signal is sent out of the delay circuit 13, the damped oscillations generated at the time of the detection operation have already been completely damped and a next measurement signal can be entered. However, for example when the detection is operated at a higher velocity than the prescribed velocity and if a next signal is sent into the delay circuit 13 before the above resetting is completed, then it may possibly become impossible to carry out the counting. In cases like this, the error indicating circuit 15 comprising the AND gate 14 and the latch issues a warning by displaying the error. Upon this, the detection operation may be made afresh with the operation velocity decelerated this time.

Upon completion of the measurement or determination in connection with a first candidate object, the reset switch 17 may be operated, whereupon an input is made from the reset circuit 16 into the pulse counter 19 and the error indicating circuit 15, whereby the counting device is returned to its original or initial operation condition. The datum (amplification degree) stored in memory in the amplification degree memory circuit 8 is maintained by the delay circuit 9 for a certain length of time, and after the lapse of such time, erased. Thus, in operating the measurement or determination in connection with a second candidate object, the counting device is automatically set afresh to a degree of amplitude adapted to the detection of the particular projections or depressions on the surface of the second object.

The counting device according to the above described first embodiment of the present invention is particularly advantageously useful where the size and/or configuration of projections or steps on a candidate object for the determination are relatively regular and output signals from the detecting unit 1 do not involve a large extent of fluctuations.

Figure 2:
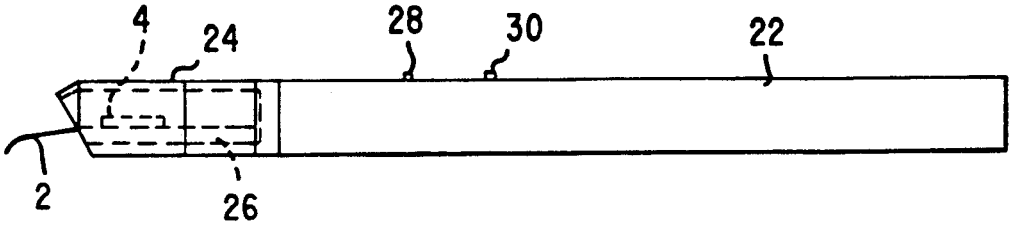
FIG. 2 shows a side elevational view of a counting device according to a second embodiment of the invention.
Figure 3:
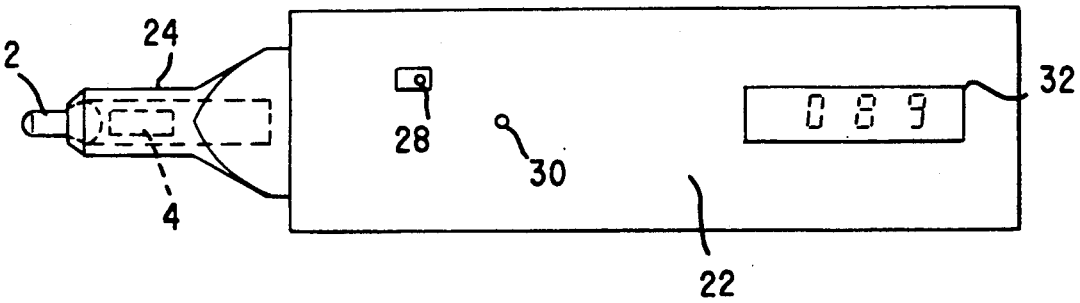
FIG. 3 is a top plan view of FIG. 2.

According to the counting device shown in FIG. 2 and FIG. 3 in accordance with a second embodiment of the invention, all the members or parts of the device starting with the detecting unit 1 and ending with the display means are housed in a relatively flat casing so that the device can be of a handy type. In FIG. 2, a tubular member 24 is provided to project from a front end of a casing 22, and a tongue-shaped springy probe 2 is secured at its root portion to a support 26 housed in the tubular member 24. The probe 2 extends inside the tubular member 24 to have its leading or forward end projected beyond the corresponding end of the tubular member 24, and it has a structure bent at an appropriate angle or curved at a suitable radius.

An acceleration sensor 4 is attached by an adhesive to the probe 2 at an intermediate point of the length of the probe inside the tubular member 24. Further, the probe 2 comprises a tongue-shaped body having a certain width so that the attachment of the acceleration sensor 4 can be facilitated. Also, when the tip end portion of the probe 2 has a certain width as above, the detection of projections or depressions on a surface of an object can be facilitated. However, where the counting can be made with a probe the tip end of which has only a relatively limited width, for example as in the cases of counting the number of sheets of a paper, the tip end width of the probe 2 may be limited. This means that the configuration of the probe 2 is not limited only to the above tongue-shaped one but can be suitably modified.

Although these are not illustrated in FIGS. 2 and 3 for avoiding complexity in illustration, within the casing 22 there are housed such as a comparator adapted to receive electric signals from the acceleration sensor 4 through a lead wire or the like, a latching circuit for receiving output signals from the comparator, a counter, a reset circuit and a power source battery. Further, on the outer surface of the casing 22, there are mounted such as a switch 28, a reset button 30 and a count indicator 32.

According to the present embodiment of the invention, it is possible to assemble various parts and members of the counting device to the form of a one-body device and omit the signal cable 21 of the before described first embodiment shown in FIG. 1, and to improve the convenience of handling of the counting device.

Figure 4:
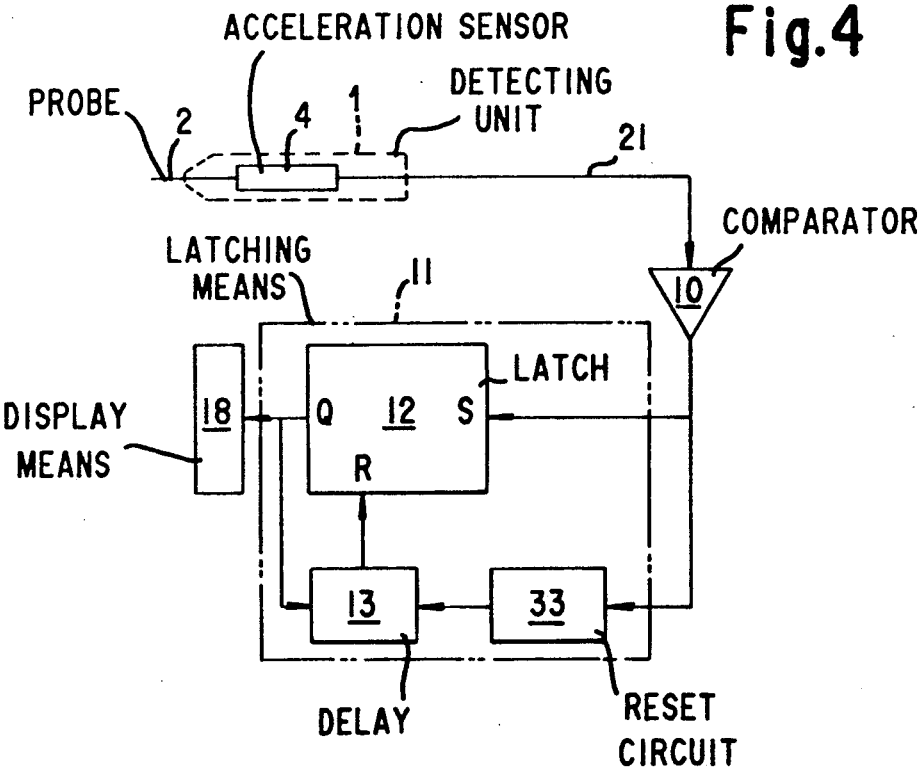
FIG. 4 is a block diagram, showing the circuit of a counting device according to a third embodiment of the invention.

FIG. 4 is a block diagram, schematically showing an example of the circuit for a counting device according to a third embodiment of the invention. In this FIG. 4, the numeral 1 represents a handy-type detecting unit in which a probe 2 having its tip end projected out of the unit 1 and an acceleration sensor 4 are housed, 10 denoting a comparator, 12 being a latch, 13 being a delay circuit for sending reset signals to a reset terminal R of the latch 12 responsive to an output from an output terminal Q of the latch 12, 18 being a display means and 33 being a reset circuit for resetting the delay circuit 13.

Figure 5:
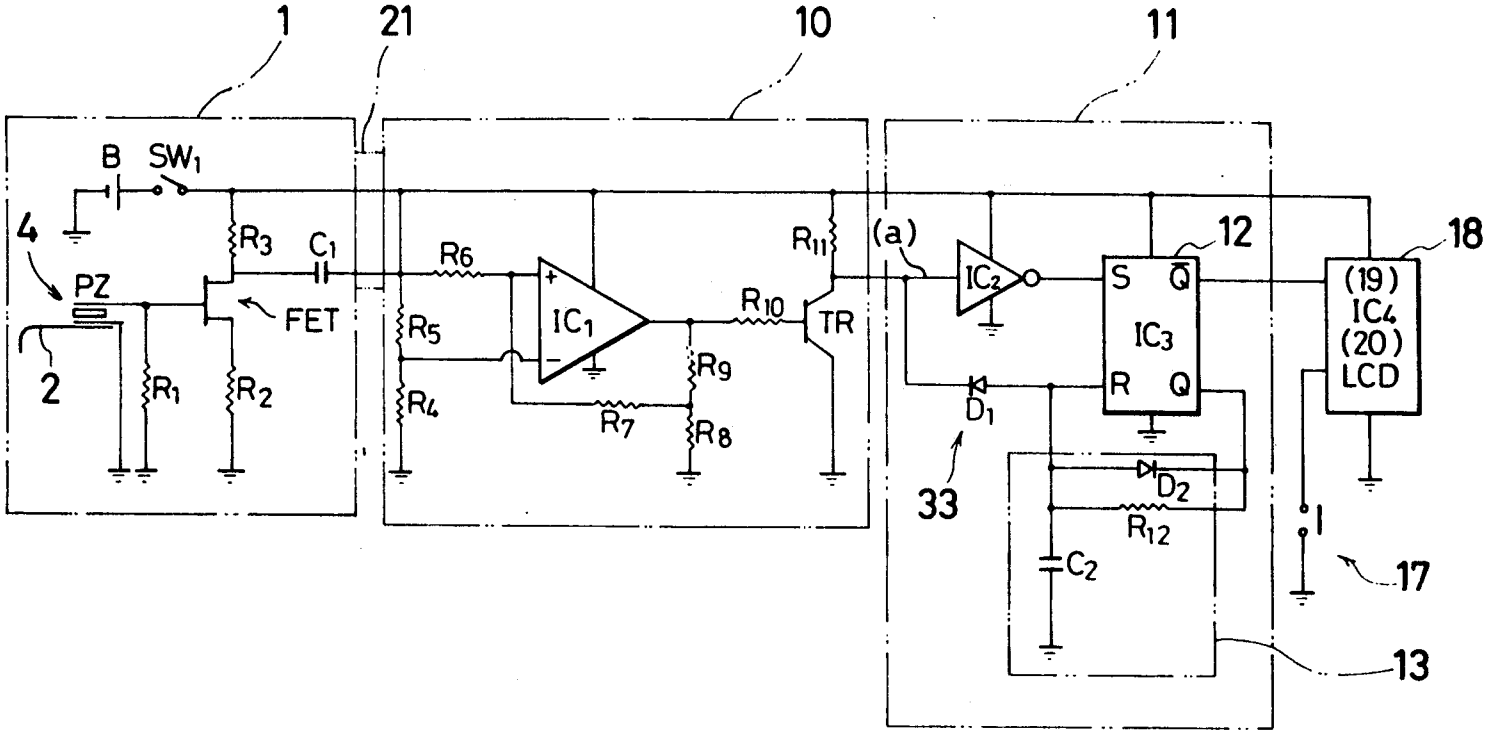
FIG. 5 shows a detailed circuit diagram of the third embodiment shown in FIG. 4.

FIG. 5 shows a detailed or practical circuit for the embodiment shown in FIG. 4. To operate the counting device of this embodiment, the detecting unit 1 may be gripped by a hand and the probe 2 may be slided on the intended surface of an object in a manner of lightly rubbing on the object surface. Vibratory motions or oscillations which the probe will undergo against very small projections on the object surface are converted into electric signals by the acceleration sensor 4 comprising a piezoelectric element PZ, and the electric signals then generated are put into the comparator 10 comprising an $IC_1$. A set voltage of the comparator 10 is determinable depending on divided voltages of resistances $R_4$ and $R_5$. When a voltage of the set point or above is put into the $IC_1$, an output is produced, whereby a transistor TR raises the voltage to a sufficient level to let the below described logical circuit to operate and, at the same time as this, the signal is inverted. The inverted signal is again inverted by a NOT circuit $IC_2$ and put into a set signal input terminal S of the latch 12 comprising a flip-flop circuit $IC_3$. Until a reset signal is sent to the reset terminal R, the number of outputs of signal from an output terminal $\overline{Q}$ is counted by the counter 19 comprising an $IC_4$, and the resulting count is put out into an indicator 20 comprising for example a liquid crystal display (LCD). In the present case, a count 1 will be displayed on the indicator 20. At the same time as above, the output from the output terminal Q of the $IC_3$ is put into a capacitor $C_2$ through a resistance $R_{12}$, when a signal delayed depending on time constants of the capacitor $C_2$ and a resistance $R_{12}$ is put into the reset terminal R, whereby the latching is released and an operation condition is restored for waiting for the input of a next pulse signal. However, when the signal from the acceleration sensor 4 is accompanied by a damped oscillation signal of a level high enough to put the comparator $IC_1$ into operation, the signal is put into the transistor TR and lowers the voltage in the line (a) to an earth level. At that time, the electric current charging the capacitor $C_2$ through the resistance $R_{12}$ flows to the side of the transistor TR passing through a diode $D_1$ and functions to prevent the latch 12 from becoming reset. That is to say, in the FIG. 5 embodiment, the reset circuit 33 (corresponding to the reset circuit 33 in FIG. 4) is made of the diode $D_1$.

In the present third embodiment of the invention, a vibratory motion which the probe 2 undergoes when it abuts against a projection to receive a flexing deformation is converted into a pulse signal by the comparator 10 and put into the latch 12. As described above, however, as long as the latch 12 is not reset, no input signals are put out, so that the possibility of an error in counting due to free vibrations of the probe 2 can be effectively cancelled. Thus, by selectively appropriately setting the time constant of the delay circuit, it is possible to prevent an operation error from ocurring even where large and small projections occur at random and/or an abnormally large projection is present on an object surface and the probe tends to undergo free vibratory motions of a relatively large extent. Accordingly, where the scanning is made of very small projections on an object surface, when no large extent of residual vibrations is likely, it is possible to accelerate the scanning velocity in comparision with the possible scanning velocity in the prior art. Then, where projections of a relatively large size are scanned, the latch 12 is reset according to the length of time during which residual vibrations continue, so that it is always possible to operate the scanning at a possible maximum speed. That is to say, providing that the scanning is made at a constant operation velocity, while the time to be consumed for the removal or dissipation of residual vibrations, namely inoperative or ineffective time, can be relatively short where the thickness of the paper sheet number of which is to be counted is relatively limited, a relatively long inoperative time is required where the thickness of the paper is relatively large, when the residual vibration tends to continue for a relatively long period of time. The counting device pursuant to the present embodiment is possessed of a function to automatically adjust the length of such inoperative time corresponding to the length of time in which the residual vibration continues.

Now, with reference to FIGS. 6 to 10, a description will be entered into the counting device according to a fourth embodiment of the invention, which makes use of the circuit of the above described third embodiment and which comprises a one-body device.

Figure 6:
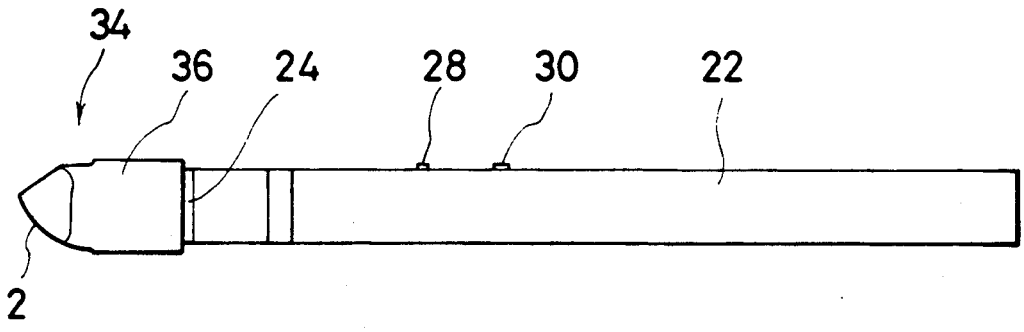
FIG. 6 shows a side elevational view of a counting device according to a fourth embodiment of the invention.
Figure 7:
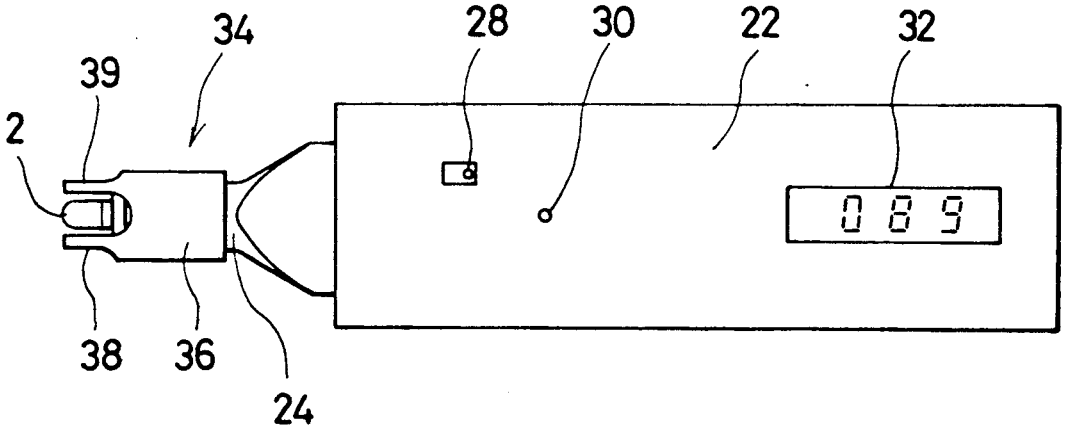
FIG. 7 is a top plan view of FIG. 6.

FIGS. 6 and 7 in combination show an overall appearance of the counting device of the fourth embodiment, which resembles the appearance of the device of the earlier described second embodiment shown in FIGS. 2 and 3 except that in the present fourth embodiment, a guide member 34 is provided surrounding the tubular member 24.

Figure 8:
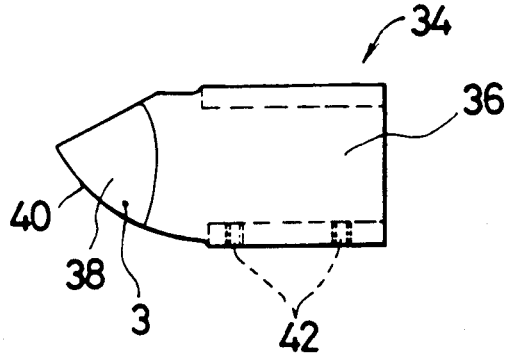
FIG. 8 is a side elevational view, showing a guide member of a counting device according to a fourth embodiment of the invention.
Figure 9:
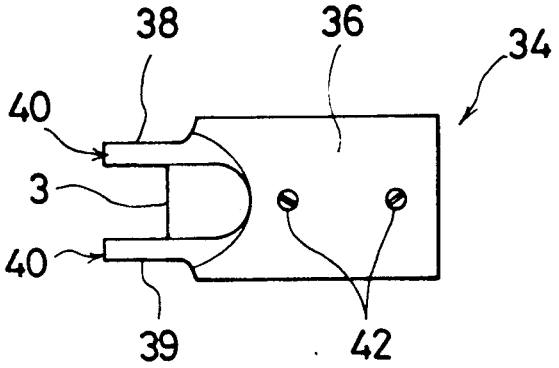
FIG. 9 shows a bottom plan view of FIG. 8.

As shown in detail in the enlarged views of FIGS. 8 and 9, the guide member 34 comprises a parallel arranged pair of flanges 38 and 39 of a plate type material, which are projected from a forward end of a tubular part 36 and integrally formed with this tubular part 36, which is fitted around the outer periphery of a forward end portion of the tubular member 24. Each of the flanges 38 and 39 has an end underside surface comprising an inclined surface 40 which is slanted relative to the axial direction of the casing 22.

Although the inclined surface 40 may comprise a flat surface (rectilinear in section), preferably it should comprise a curved face having a radius on the order of 30 mm.

A damper 3 comprising a bar for limiting the motion of the probe 2 is provided between the inner surfaces of the pair of flanges 38 and 39.

By fitting the tubular part 36 around the outer periphery of the forward end portion of the tubular member 24 and fixing this tubular part 36 in position by tapping screws 42 applied through the wall of the tubular part 36, the flanges 38 and 39 can be arranged at the left and the right sides of probe 2 projecting from the tip end of the tubular member 24 in a manner such that the flanges do not touch to constrain the probe 2. The probe 2 is so arranged as to be bent with the flanges 38 and 39 as the point of bending, and while a forward end portion of the probe 2 abuts against the damper 3, the tip end of the probe is projected to an appreciable length from an intermediate point of the inclined surface 40.

Further, in the present fourth embodiment, flanges 380and 39 are tapered to have a pointed tip end and respectively as shown in the side elevational view of FIG. 8 and their respective upper edges are inclined at an angle almost same the angle at which the probe 2 is bent or curved. Also, their upper edges are spaced from each other as shown in the bottom plan view of FIG. 9. However, insofar as the motion of the probe 2 is not disturbed, the flanges are not required to have pointed tip ends, nor is it required that an open space is provided between their upper edges.

Furthermore, while the guide member 34 is removably mounted in the present embodiment, alternatively it may be integrally formed with the tubular member 24 or be formed by an extended portion of the tbular member 24.

Characteristics of the above described counting device according to the fourth embodiment of the invention and those of the counting device according to the second embodiment shown in FIGS. 2 and 3 will now be put to a comparison with each other.

In pressing the probe 2 against projections on an intended object for the determination or a candidate object, a certain extent of skill is required to appropriately adjust the pressure to be applied to the probe 2 in the case of the counting device of the second embodiment. That is to say, the tongue-shaped probe 2 is for pressing at its tip end against a surface of the candidate object having projections, and if it is extremely lightly touched against the object surface, the effect of sensing tends to be insufficient due to an insufficient force application. On the other hand, now that the probe 2 is in a condition of being free to vibrate inside the tubular member 24, if an excess force is applied to the probe 2, it tends to impair the object surface or to become bent. The counting device of the fourth embodiment can be easily operated without exerting a particular skill, and according to the fourth embodiment, it is possible to obtain a counting device which is more easy to operate than the device of the second embodiment.

Now, a description will be given to the way of use and the operation of the counting device of the fourth embodiment.

Figure 10:
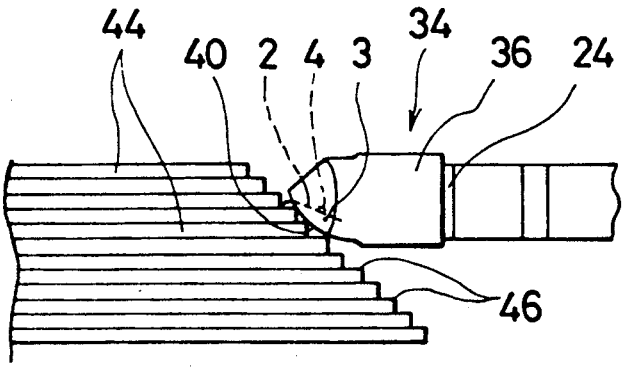
FIG. 10 is a view taken for illustration of an example of the manner in which the counting device of the fourth embodiment may be put to use.

Fig. 10 illustrates a condition in use of the device of the present embodiment, namely the fourth embodiment. When the device is not put to use, the tip end of the probe 2 is only appreciably projected from the inclined surface 40 of the guide member 34. Then, in use of the device, it may be pressed against a projection surface 46 of the object of which the counting of projections is intended until the inclined surface 40 abuts against the projection surface 46 of the object.

For example, where the intended object or candidate object for the counting 44 comprises a stack of a thin paper such as a bundle of a paper money and the projection surface 46 comprise respective edges at respective one side ends of the paper sheets which are successively staggered like stairs in staircases, it may be operated to slide the inclined surface 40 of the counting device along the edges of the object 44 in contact with the edges, when the tip end portion of the probe 2 is snapped each time when it is pressed against the projection surface 46, in the plane on the track of the movement of the sliding surface 40. The snapping of the tip end of the probe 2 caused when the inclined surface 40 of the counting device is moved successively over a number of projection surfaces 46 takes place itermittently succesively substantially without a time interval.

Each time the probe 2 moves over a projection surface 46, it undergoes a vibration as a result of a spring effect and the accleration sensor 4 does the same. As hereinbefore described, an electric signal generated as a result of the vibration of the acceleration sensor 4 is put into the comparator, and when an electric signal of a certain preset level or above is put into the comparator, it produces an output to actuate the counter through the latching circuit, whereby a count is displayed on the count indicator 32.

As described in detail in the foregoing, in or of the counting device according to the present invention, the circuit construction is very simple, and according to the present invention, it is possible to provide a counting device which is relatively small in size and is in a form facilitating the convenience of carriage by hand. In addition, the counting device according to the invention can count the number of very small projections or steps of which the height from a reference level or adjacent steps is so limited as to be only on the order of 10 $\mu$m, so that it can be highly easily utilized in counting the number of sheets of a thin paper or counting a great number of projections or grooves or concaves on a surface of an object or in embossed patterns having a height difference only of a appreciable degree.

What is claimed is:

1. A device for counting very small projections or steps on a surface of an object, comprising:

a detecting unit having a probe to be brushed against a surface of an object having very small projections or steps, and an acceleration sensor connected to the probe for detecting acceleration of said probe as said probe is brushed against the projections, said acceleration sensor producing an output signal in response to acceleration of said probe;

a signal converting means, receiving as an input a signal corresponding to the output of said acceleration sensor, for converting the signals emitted from said acceleration sensor into output pulse signals which represent acceleration of said probe;

a latching means receiving said pulse signals from said signal converting means, for latching the output pulse signals from said signal converting means having a value corresponding to the acceleration of said probe, said latching means producing a latched output signal, and said latching means including a latching circuit and a delay circuit for resetting said latching circuit after said latching circuit has maintained a latched output signal for a predeternmined period of time;

a counter for counting the number of latched output signals output by said latching means and for producing a signal representing the number of latched outpout signals counted;

a display means receiving the output signal from said counter, for displaying a number representing the number of latched output signals counted by said counter; and an error indicating means connected to said signal converting means and said delay means for indicating when said output signal is received at said latching means before said predetermined period of time has elapsed.

2. A device as claimed in claim 1, further comprising an amplification circuit disposed between said detecting unit and said signal converting means, such that said amplification circuit receives the output from said detecting unit and outputs an amplified signal to said signal converting means, said amplification circuit comprising an amplification degree memory circuit, a delay circuit and an automatic gain control circuit.

3. A device as claimed in claim 1, wherein said latching circuit includes a set terminal and a reset circuit, and wherein said pulse signals emitted from said signal converting means are supplied to said set terminal of said latching circuit and to said reset circuit for blocking said delay circuit, said latched output signal emitted from an output terminal of said latching circuit are supplied to said delay circuit, such that after a delay after receipt of a signal from said output terminal of said latching circuit, said delay circuit emits a reset signal to said reset terminal of said latching circuit, in response to said reset signal from said delay circuit said reset circuit supplying blocking signals to said delay circuit for maintaining said delay circuit in a clocked condition while said pulse signals are emitted by said signal converting means.

4. A device as claimed in claim 1, 2 or 3, further comprising a casing, wherein said detecting unit and said counter are housed in said casing, and wherein said probe includes a top end portion which projects out of a forward end of said casing.

5. A device as claimed in claim 4, wherein said probe has an elasticity, and said casing includes a guide member which surrounds said probe while not constraining movement of said probe and while permitting said tip end portion of said probe to project out of said corresponding end of said guide member.

6. A device as claimed in claim 5, wherein said guide member has a surface portion which is brushed against an object surface to be scanned during operation of said device, and wherein said surface portion of said guide member is inclined relative to the longitudinal axis of said casing.

* * * * *